US005131554A

United States Patent [19]

Kuo

[11] Patent Number: 5,131,554

[45] Date of Patent: Jul. 21, 1992

[54] PULL RING OPENER AND DUST COVER ASSEMBLY FOR THE SEALING CAP OF A CONTAINER

[76] Inventor: Chung-Sheng Kuo, No. 21, Lane Kuang I, Hsi Pan Village, Hsi Chou Hsiang, Changhua, Taiwan

[21] Appl. No.: 701,995

[22] Filed: May 17, 1991

[51] Int. Cl.[5] ..... B65D 51/22

[52] U.S. Cl. ..... 220/258; 220/255; 220/256; 220/270

[58] Field of Search ..... 220/254, 255, 256, 257, 220/258, 270

[56] References Cited

U.S. PATENT DOCUMENTS

| | | | |
|---|---|---|---|
| 3,204,805 | 9/1965 | May | 220/258 X |
| 3,845,880 | 11/1974 | Cole, Jr. | 220/258 |
| 4,125,203 | 11/1978 | Sovari et al. | 220/258 |
| 4,162,023 | 7/1979 | Faltermeier | 220/258 |
| 4,708,257 | 11/1987 | Deline | 220/257 |
| 4,749,100 | 6/1988 | Eberhart | 220/306 |

*Primary Examiner*—Stephen Marcus
*Assistant Examiner*—Nova Stucker
*Attorney, Agent, or Firm*—Bacon & Thomas

[57] ABSTRACT

The sealing cap of a container is provided with a pull ring opener wherein a dust cover is interposed between the pull ring and the top of the sealing cap by securing the pull ring to the strip portion of the sealing cap through an aperture formed in the dust cover.

1 Claim, 2 Drawing Sheets

PULL RING OPENER AND DUST COVER ASSEMBLY FOR THE SEALING CAP OF A CONTAINER

FIELD OF THE INVENTION

1. Field of the Invention

The present invention generally relates to the field of technology pertaining to an integrated opener for the top of a container. More particularly, the invention involves an improved pull ring opened and dust cover assembly for the sealing cap of a container wherein the assembly prevents dust from contacting the top surface of the sealing cap prior to opening of the container and injury to the user from the sharp edge of the strip portion removed from the sealing cap.

2. Description of the Prior Art

Containers having openers which utilize a pull tab or pull ring are commonly used for containing a variety of foods and beverages. When a container having such an opener is stored on a merchandise rack, the top of the container and the opener device may easily be covered by dust, therefore requiring the top of the container to be cleaned before use. To eliminate this problem, it is known to provide an opener with an associated plastic cover which must first be removed prior to operating the opener. Since the opener structure becomes fully exposed upon removal of the cover, its operation could cause injury to the user due to the sharp edge of the slit portion that is carried away by the pull ring to define the opening in the container top.

SUMMARY OF THE INVENTION

The present invention serves to overcome the above descried problems associated with known container openers of the pull ring type.

It is therefore an object of the present invention to provide a safety pull ring opener and dust cover assembly for the sealing cap of a container which can seal off dust from the top of the cap prior to opening the container.

It is another object of the present invention to provide a safety opener and dust cover assembly for the sealing cap of a container which prevents injury to the user from the sharp edge of the split portion which is carried away by the pull ring of the opener.

It is still a further object of the present invention to provide a safety opener and dust dust cover assembly for the sealing cap of a container which can be reattached to the container to seal the opening created by operation of the opener.

The above and other objects of the invention are realized by providing a safety opener and dust cover assembly wherein the pull ring of the opener is riveted to the top of the sealing cap and the dust cover is secured in position between the pull ring and the sealing cap by extending a rivet carried by the sealing cap through a hole in the dust cover and attaching the pull ring to the outer end of the rivet.

Through this arrangement, when the pull ring is pulled against the container in a conventional manner, a split portion of the sealing cap defining the opening is removed with the pull ring and the dust cover remains attached therebetween. Injury by the sharp edge of the split portion is prevented due to the presence of the dust cover, the latter being reattachable to the top of the container to reseal any unconsumed contents or prevent vermin from entering the container after its disposal.

Other objects, features and advantages of the invention will become apparent from the following detailed description of a preferred embodiment thereof, when taken in conjunction with the drawings wherein like reference characters refer to corresponding parts of the several views.

DETAILED DESCRIPTION OF THE PREFERRED EMBODIMENT

Figure 1:
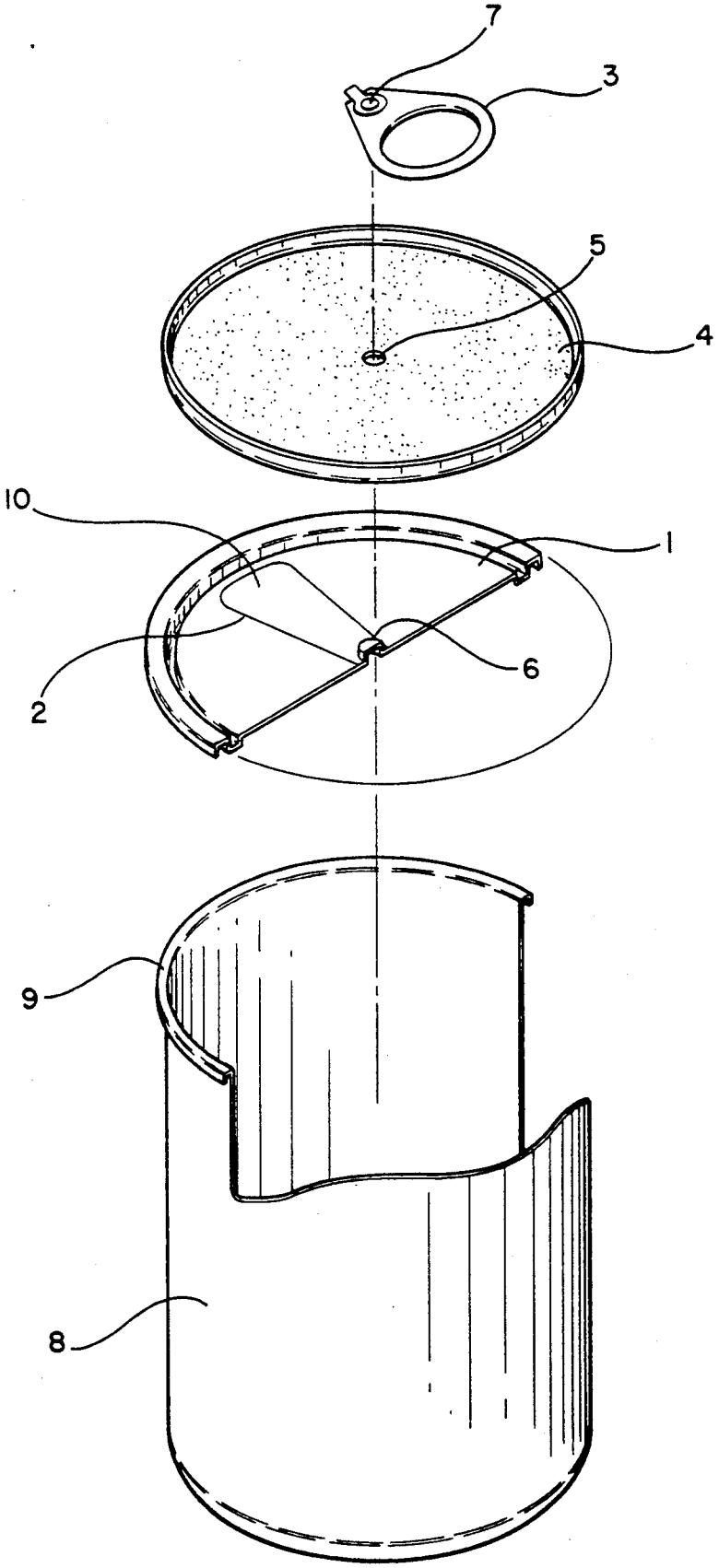
FIG. 1 is an exploded perspective view of an opener constructed according to the present invention.

Referring to FIG. 1, there is shown an opener constructed according to the present invention for use with a container 8 for containing a beverage of food product. The opener generally comprises a sealing cap 1 having its periphery sealed around a top opening 9 of container 8, a dust cover 4 enclosing the exposed top portion of sealing cap 1, and a pull ring 3 riveted to a sealing cap 1 with dust cover 4 being securely retained therebetween.

Sealing cap 1 is provided with a stub or rivet 6 extending upwardly from the center thereof and a continuous indentation line 2 having two opposite ends connected to rivet 6. Line 2 defines a long and narrow split portion 10 of sealing cap 1 which, when removed, forms an opening through which the contents of container 8 are dispensed.

Pull ring 3 is provided with a rivet hole 7 at one end of receiving the outer end of rivet 6 therethrough. As also indicated, dust cover 4 is provided with a center aperture 5 which permits cover 4 to be mounted onto sealing cap 1 and with rivet 6 extending outwardly through aperture 5.

After sealing cap 1 is molded onto opening 9 of container 8 during he manufacturing process, dust cover 4 is then placed on sealing cap 1 so that rivet 6 extends outwardly through aperture 5. Thereafter, rivet 6 is inserted through rivet hole 7 of pull tab 3, after which the outer end of rivet 6 is punched to form an enlarged rivet head. This serves to securely attach pull ring 3 to sealing cap 1 with dust cover 4 being firmly retained therebetween. As apparent, pull ring 3 is positioned on the exterior side of dust cover 4, while the top of sealing cap 1 is positioned on the interior side of dust cover 1.

Figure 2:
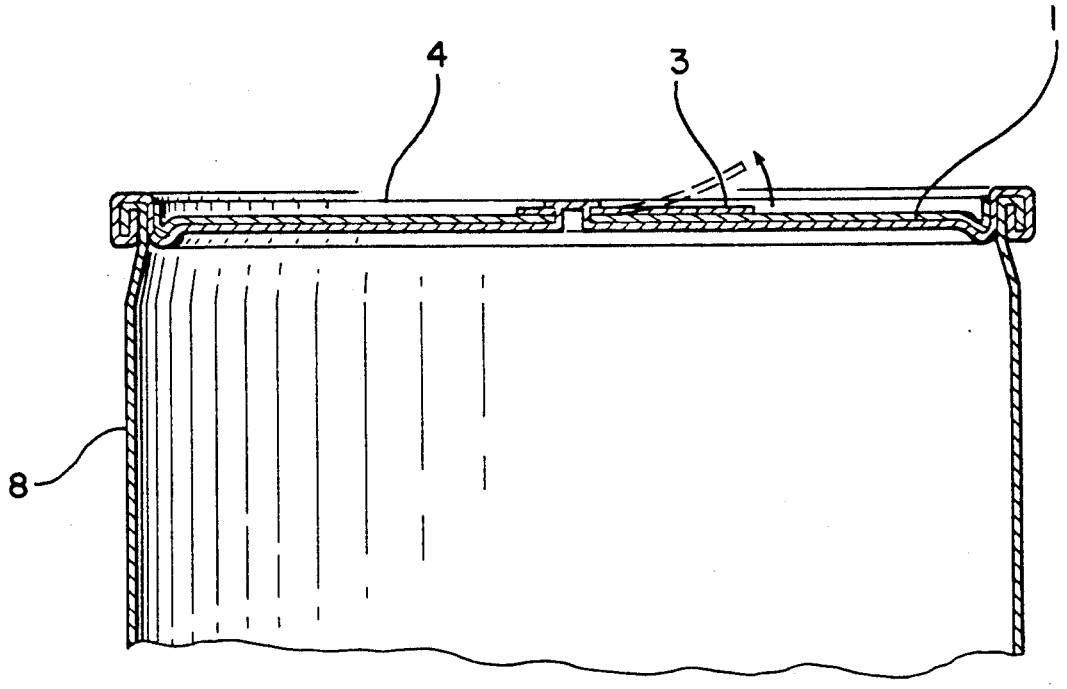
FIG. 2 is a partial sectional assembly view of the opener and dust cover assembly combined with the sealing cap of a container.
Figure 3:
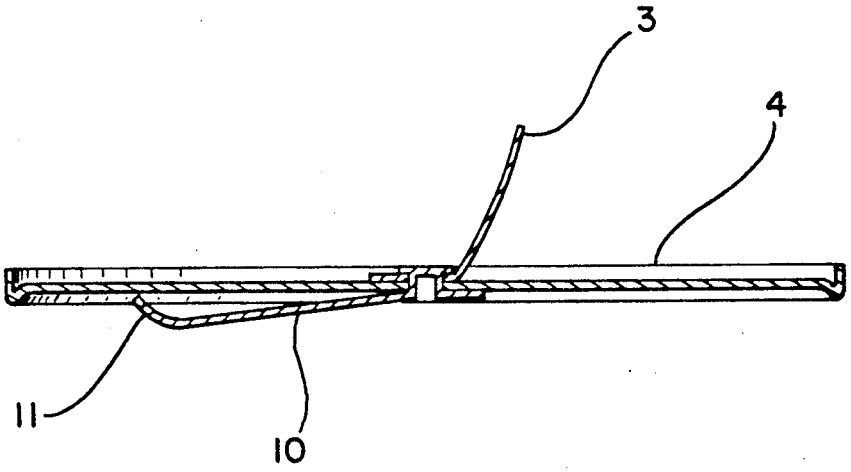
FIG. 3 is a sectional view of the dust cover, pull ring and split portion after same has been removed from the open container.

With reference to FIGS. 2 and 3 it can be seen that dust cover 4 is firmly retained by pull ring 3 to closely cover over the top surface of sealing cap 1 and prevent dust from accumulating thereon. When a user desires to drink or eat the contents of container 8, pull ring 3 is grasped and pulled to strip the portion 10 from sealing cap 1 along indentation line 2, thereby forming an opening in sealing cap 1 having a configuration corresponding to indentation line 2. This operation permits the complete separation and removal of pull ring 3 and split portion 10 form sealing cap 1. Since dust cover 4 is securely attached between pull ring 3 and split portion 10, it also is removed from sealing cap 1 in the form of an assembly therewith. Therefore, the top surface of sealing cap 1 is exposed and is clean since any dust accumulation would have occurred on the exposed surface of dust cover 4. The contents of container 8 may then be consumed through the opening in sealing cap 1 formed by the removal of split portion 10 and without any contamination problems.

It is apparent that the attachment of dust cover 4 to pull ring 3 permits cover 4 to effectively serve as a barrier between the fingers of the user and the sharp edge of split portion 10, thereby preventing injury to the user. Since dust cover 4 remains attached to pull ring 3 and split portion 10, the combination of these components form a large assembly which may cause the user to have less tendency towards littering. Finally, it is a simple matter to reattach dust cover 4 to sealing cap 1 to reseal the opening if the contents of container 8 are not completely consumed by the user, or to prevent vermin from entering into container 8 after its disposal.

I claim:

1. A container opener of the type wherein a pull ring is secured to the top sealing cap of a container by a rivet for forming an opening in the cap by removing the pull ring and a split portion defined by an indentation line in the cap, the improvement comprising a dust cover for enclosing the sealing cap and preventing dust accumulation thereon prior to the opening of the container, wherein the dust cover includes an aperture through which the rivet securing the pull ring to the sealing cap is disposed to position the pull ring on an exterior side of the dust cover and the sealing cap on an interior side of the dust cover so that the dust cover is simultaneously removed from the sealing cap with the pull ring and split portion during opening of the container.

* * * * *